US009254428B2

(12) United States Patent
Kriticos

(10) Patent No.: US 9,254,428 B2
(45) Date of Patent: Feb. 9, 2016

(54) SURFING DEVICE AND METHOD

(75) Inventor: Stephen Con Kriticos, Caboolture (AU)

(73) Assignee: Whitewater West Industries Ltd., British Columbia (CA)

( * ) Notice: Subject to any disclaimer, the term of this patent is extended or adjusted under 35 U.S.C. 154(b) by 67 days.

(21) Appl. No.: 13/997,012

(22) PCT Filed: Dec. 21, 2011

(86) PCT No.: PCT/AU2011/001665
§ 371 (c)(1),
(2), (4) Date: Jun. 21, 2013

(87) PCT Pub. No.: WO2012/083373
PCT Pub. Date: Jun. 28, 2012

(65) Prior Publication Data

US 2013/0337422 A1 Dec. 19, 2013

(30) Foreign Application Priority Data

Dec. 21, 2010 (AU) ..... 2010905568

(51) Int. Cl.
*A63G 21/18* (2006.01)
*A63B 69/00* (2006.01)
*A63G 21/00* (2006.01)

(52) U.S. Cl.
CPC ..... *A63B 69/00* (2013.01); *A63B 69/0093* (2013.01); *A63B 2209/08* (2013.01); *A63B 2210/50* (2013.01); *A63B 2225/09* (2013.01); *A63B 2225/60* (2013.01)

(58) Field of Classification Search
CPC ..... A63G 21/00; A63G 21/18; A63G 31/007; A63B 67/007; A63B 2009/006; A63B 2009/008; A63B 2208/12
USPC ..... 472/13, 116, 117, 128, 129; 405/52, 79
See application file for complete search history.

(56) References Cited

U.S. PATENT DOCUMENTS

| | | | | |
|---|---|---|---|---|
| 5,738,590 | A * | 4/1998 | Lochtefeld | 472/117 |
| 7,547,255 | B2 * | 6/2009 | Lochtefeld | 472/90 |
| 2004/0244636 | A1 | 12/2004 | Meadow, Jr. et al. | |
| 2004/0245780 | A1 | 12/2004 | Roberts | |
| 2006/0093435 | A1 | 5/2006 | Unterweger | |
| 2008/0044621 | A1 | 2/2008 | Strauss | |
| 2008/0262666 | A1 | 10/2008 | Manning | |

OTHER PUBLICATIONS

International Preliminary Report on Patentability of PCT/AU2011/001665 dated Apr. 2, 2013.

* cited by examiner

*Primary Examiner* — Kien Nguyen
(74) *Attorney, Agent, or Firm* — Rankin, Hill & Clark LLP

(57) ABSTRACT

The present Invention provides a surfing device comprising at least one energy projecting means and at least one energy projecting structure for supporting and positioning the energy projecting means. The energy projecting structure positions the energy projecting means at one or more energy projecting positions. Energy is projected from the energy projecting means from positions to enable a person to surf at least partially solely via the projected energy. The present invention also provides a surface for a surfing device, either the device of the present Invention or another surfing device. The surface, is designed for a person to surf on either via the projected energy of the surfing device of the present Invention or by at least partially direct contact with the surface via fluid projected out of, over or upon it. The surface has an Impact absorption material. The material Is at (east partially porous and at least partially deformable and also designed to at least partially deform upon impact to at least partially absorb or diffuse the impact.

29 Claims, 16 Drawing Sheets

SURFING DEVICE AND METHOD

FIELD OF THE INVENTION

The present invention relates broadly to water sports of surfing and skiing and in particular, though not exclusively, to surfing or skiing simulation and impact materials for ride surfaces of such simulation. However, these impact materials are suitable for any application and as such are not limited to ride surfaces of the present invention. The present invention is also not limited to simulation of typical surfing or skiing comprising for example a surf board or boogie board, or skis.

BACKGROUND OF THE INVENTION

Surfing is a very common sport and is popular in many parts of the world. A large number devices for simulating surfing have to date been designed. Australian patent number 777355 titled Device and Method for Forming Waves and corresponding patent applications and patents are those of the present applicant. Specifications of these patent applications and patents include a general background of surfing simulation. They also explain shortcomings of the field, some of which are addressed by the invention described therein. It is however desirable, to more effectively overcome these shortcomings.

SUMMARY OF THE INVENTION

In one aspect of the present invention there is provided a surfing device comprising at least one energy projecting means and at least one corresponding energy projecting structure, said energy projecting structure being arranged for supporting said energy projecting means to provide a plurality of energy projecting positions for projection of energy therefrom and said energy projecting means being arranged to project energy from said plurality of energy projecting positions to provide a virtual surfing surface positioned relative to each of said plurality of energy projecting positions a predetermined distance therefrom in a direction of projection of said energy, wherein and said energy projecting means is arranged to project said energy from said plurality of energy projecting positions to enable a surfer to surfer at least substantially naturally upon said virtual surfing surface at least partially solely via said projected energy.

In another aspect of the present invention there is provided an impact absorbing sheet of the type providing a ride surface, said sheet having a plurality of apertures for passage of fluid there through and being arranged to at least partially deform upon impact by a person riding over said surface to at least partially reduce energy imparted to said person during said impact. The impact absorbing sheet is more preferably of the type providing a surfing surface of a surfing device arranged for a person to surf thereon or thereover. And still more preferably the impact absorbing sheet is of the type providing a surfing surface of a surfing device arranged for projection of energy to enable said person to surf at least substantially naturally upon or over said surfing surface at least partially solely via said projected energy.

In a still another aspect of the present invention there Is provided an impact absorption material comprising a plurality of cavities, said cavities being formed by two or more pairs of at least substantially oppositely positioned walls, said walls being arranged to absorb an impact provided by a body approaching said cavities from either an open or closed end thereof, wherein said walls are arranged to at least partially deform upon impact to at least partially reduce energy imparted to said impact body during said Impact.

In a yet aspect of the present invention there is provided an impact absorbing sheet, said sheet having a plurality of apertures for passage of fluid therethrough, wherein said apertures being arranged to at least partially deform upon impact on either side thereof by a object to at least partially reduce energy imparted to said object during said Impact.

In a further another aspect of the present invention there is provided a surfing device kit of parts comprising a. components for construction of at least one energy projecting means and at least one corresponding energy projecting structure, said at least one energy projecting structure being arranged to support and position said energy projecting means to provide a plurality of energy projecting positions for projection of energy therefrom and said energy projecting means being arranged to project energy to provide a virtual surfing surface positioned relative to each of said plurality of energy projecting positions a predetermined distance therefrom in a direction of projection of said energy;

b. instructions for assembly of said components to construct said energy projecting means and structure, and to support and position said energy projecting means via said energy projecting structure to provide said plurality of energy projecting positions; and c. instructions to project energy from said plurality of energy projecting positions to provide said corresponding virtual surfing surface, and to thereby enable a surfer to surf at least substantially naturally upon said virtual surfing surface at least partially solely via said projected energy.

Said surfing device kit of parts preferably further comprising instructions for assembly of said components to construct said energy projecting means and structure, and to support and position said energy projecting means via said energy projecting structure to provide said plurality of energy projecting positions.

More preferably, said instructions further comprise instructions for one or more of the following in relation to said one aspect of the present invention: assembly of said energy projecting means; assembly of said energy projecting structure and energy projecting means for projection of energy by said energy projecting means from said one or more positions to enable a person in the form of a surfer to surf at least partially solely via said projected energy.

In a preferred embodiment, said energy projecting means and energy projecting structure are arranged to enable a person to surf at least substantially solely via said projected energy.

Said surfing is preferably enabled by interaction of said person, and more preferably their surfboard or boogie board, with said projected energy. Preferably, one or more of said energy projecting means and energy projecting structure are arranged to simulate an ocean wave. In this more preferred form said surfer surfs at least essentially naturally upon said virtual surfing surface. This essentially natural surfing is one example of the present invention of surfing substantially naturally. In a most preferred form this essentially natural surfing is essentially equivalent, or even equivalent, to surfing an ocean wave.

In a more preferred embodiment said energy projecting means is further arranged to project energy from a position proximal said virtual surfing surface, Preferably, said proximal position is removed from said virtual surfing surface by a distance ranging from approximately 5 mm to approximately 50 mm but is more preferably removed by a distance ranging from approximately 10 mm to approximately 25 mm.

The energy projecting means and corresponding energy projecting structure of the surfing device are preferably arranged to project energy at a given instant only from specific energy projecting positions. The specific energy projecting positions preferably comprises a single position. Still more preferably the specific energy projecting positions comprise a single position and a predetermined number of other of said plurality of energy projecting positions which are proximal said single position. In a preferred embodiment the energy projecting means or energy projecting structure or both said energy projecting means and energy projecting structure of the surfing device is arranged to coincide said specific energy projecting positions with a position of a surfer at said given instant to thereby enable a surfer to surf at least substantially naturally upon said virtual surfing surface at least partially solely via said projected energy. In a more preferred embodiment the energy projecting means or energy projecting structure or both said energy projecting means and energy projecting structure Is arranged to predict said specific energy projecting positions. Prediction of the specific positions is preferably achieved using one or more of: algorithms; said surfer's movement; one or more of said surfer's previous positions.

Preferably, said device further comprise a safety surface and correspondingly, said kit of parts preferably further comprises components for constructions of said safety surface, wherein said safety surface is arranged to support a person upon completion, voluntarily or otherwise, of said surfing. More preferably, said instructions further comprise instructions for one or more of the following in relation to said one aspect of the present invention: assembly of said safety surface; assembly of said energy projecting structure and safety surface for support a person upon completion, voluntarily or otherwise, of said surfing.

Said energy projecting means of one preferred embodiment is arranged to project fluid. In this preferred embodiment said energy projecting means preferably comprises energy projecting outlets, and more preferably nozzles in an alternative preferred embodiment, the energy projecting means is arranged, for example, to project electromagnetic energy. In yet another alternative preferred embodiment the energy projecting means is arranged to project a combination of one or more of these and suitable alternative non-specified forms of the energy. The energy projecting means is preferably arranged to provide the most efficient method of transfer of energy to said person.

The energy projecting means is preferably arranged to project energy at values ranging from approximately 150kgf per square meter to approximately 500kgf per square meter.

The energy projecting means is preferably arranged to project energy at an angle ranging from approximately 5 to approximately 35 degrees relative to a tangential plane which is tangential to said surface. However, the angle of projection more preferably ranges from to approximately 135 degrees relative to a longitudinal edge of said elongate surface. In another alternative preferred form of this aspect of the present invention the virtual surfing surface is shaped to simulate the shape of an ocean wave. In this other alternative preferred form said longitudinal edge also comprises a lower elongate edge of said surface.

More preferably, at least one or more of the following features of said device are adjustable, either statically or dynamically or both statically and dynamically: said amount of said projected energy; said energy projection angle; said shape of said surface. Said features are more preferably independently adjustable. Still more preferably, a specific feature is independently adjustable at different positions of said surface so that it can be set at different values at different positions. Said static and dynamic adjustment of said features preferably corresponds to static and said dynamic fluid relief adjustment. It preferably also further comprises manual and automatic adjustment control corresponding to said manual and automatic fluid relief adjustment.

In a further preferred embodiment, said device is arranged for static adjustment of at least one or more of the following: said position of said energy projecting means; and said energy projection means including its energy projection capacity. Said static adjustment of said energy projecting means preferably corresponds to static fluid relief adjustment. It preferably also further comprises manual and automatic adjustment control corresponding to said manual and automatic fluid relief adjustment, In a yet further alternative preferred form of this aspect of the present invention said virtual surfing surface is not shaped to simulate the shape of an ocean wave but instead is substantially horizontal. In this yet further alternative preferred form said virtual surfing surface is preferably also substantially flat. More preferably, said surface of said yet further alternative preferred form is above a body of fluid. Preferably, said device further comprise at least one floatation means and correspondingly, said kit of parts preferably further comprises components for constructions of said at least one floatation means arranged for supporting said device upon or at least partially within said body of fluid and providing said virtual surfing surface above, or just beneath the surface of, said body of fluid. More preferably, said instructions further comprise instructions for one or more of the following in relation to said one aspect of the present invention: assembly of said floatation means; assembly of said energy projecting structure and said floatation means for supporting said device upon or at least partially within said body of fluid. The one or more floatation means may, for example, be integrally formed with said device. Alternatively, the floatation means may be connected to said device.

Said floatation means preferably comprises one or more floatation devices. Each of said one or more floatation devices preferably comprise at least one float. Said float is preferably at least statically adjustable between two or more float positions. In an alternative preferred float embodiment, said float is dynamically adjustable. This alternative preferred float embodiment may further comprise said statically adjustable float embodiment. In a further alternative float embodiment floatation support provided to different regions of said surface is independently adjustable, either statically or dynamically or both statically and dynamically.

Said static and dynamic float adjustment preferably corresponds to static and said dynamic fluid relief adjustment. It preferably also further comprises manual and automatic adjustment control corresponding to said manual and automatic fluid relief adjustment.

In one preferred form of this aspect of the present invention said device further comprises another surfing surface positioned between said plurality of energy projecting positions and said virtual surfing surface. The at least one energy projecting means is preferably arranged to project said energy through said other surface.

Said floatation means is preferably substantially uniformly spread underneath said other surface for support thereof. Said flotation means preferably comprises a density of floats ranging from approximately one float per sq meter to approximately 100 floats per sq meter. Said float density preferably depends on one or more of at the following: desired characteristics of said device; float buoyancy. The preferred buoyancy of said floats ranges from approximately 40kgs per sqm at 100mm depth to approximately 300kgs per sqm at 100mm depth, It is also preferred that said floatation means is arranged to provide a trampoline effect whereby depression of said other surface into said body of fluid results in said surface being subsequently forced upwardly by said body of fluid. Said trampoline effect is preferably arranged to at least partially facilitate surfing maneuvers. It preferably also at least partially enhances enjoyment.

The yet further alternative preferred form of this aspect of the present invention said other surface preferably further comprises raised regions. Said raises regions preferably provide at least one or more of the following: an obstacle; a ramp.

Preferably, said energy projecting structure is further arranged for adjustment of a position or shape of either one or more portions or all of said virtual surfing surface and either statically or dynamically or both statically and dynamically and correspondingly, said kit of parts preferably further comprises components for said adjustment. More preferably, said instructions further comprise Instructions for one or more of the following In relation to said one aspect of the present invention; assembly of said adjustment components; assembly of said energy projecting structure and said adjustment components for adjustment of a position or shape of either one or more portions or all of said virtual surfing surface and either statically or dynamically or both statically and dynamically and correspondingly. Said positional adjustment may, for example, be vertical, horizontal or any combination thereof. Said static and dynamic adjustment In relation to said support means preferably corresponds to static and said dynamic fluid relief adjustment. Preferably, said structure further comprises manual and automatic adjustment control corresponding to said manual and automatic fluid relief adjustment. Said adjustment via said energy projecting structure is preferably arranged to simulate an ocean wave, More preferably said structure is further arranged to support said fluid relief means. In one preferred form of this aspect of the present invention said energy projecting structure comprises support cables.

Preferably said other surface of said one aspect of the present Invention comprises the impact absorbing sheet of said other aspect of the present invention, Said other surface is preferably formed of PVC. It will however be readily apparent to a person skilled in the relevant art that other materials could be used instead of or as well as PVC. Said other surface is preferably arranged to support one or more said persons upon completion, voluntarily or otherwise, of said surfing. In this preferred form of said other surface comprising support of a person said other surface comprises said safety surface. Preferably, said support cables pass underneath said other surface for support thereof. Said cables preferably loop underneath said other support surface.

Preferably, any interaction of significance to said surfing that occurs between said energy and said other surface only occurs subsequent to said enablement of said surfing. Said projected energy is preferably further arranged to enable said person to surf upon said virtual surfing surface substantially without contacting said other surface and without corresponding friction that would otherwise result from said contact.

Said other surface is preferably at least partially porous to facilitate drainage of fluid from said surface. Said other surface of said one aspect of said surfing device preferably comprises said Impact absorption material of said other aspect of the present invention. Said at least partially deformable other surface is preferably arranged to at least partially enhance ride safety.

Preferably said at least partially porous material, of said one or other aspects of the present invention comprises at least partially porous regions. It is preferred that a fluid relief or drainage ratio, expressed as a ratio of surface area of said other surface that Is fluid permeable relative to the remainder of the surface area of said other surface, is approximately 0.52 sqm per sqm. However a preferred range of said fluid relief ratios range from approximately 0.35 sqm per sqm to approximately 0.75 sqm per sqm, or approximately 35% to approximately 75%.

Said at least partially porous regions preferably comprise apertures. The apertures are preferably formed by two corresponding pairs of oppositely positioned walls, dividers or strips that collectedly define rectangular shaped apertures. Said material of said other aspect of the present invention is preferably substantially thick, in a cross-section that is arranged to absorb said impact. In relation to an impact barrier for example this may for example comprise a thick pillar or rail, or both. In a preferred form of said material suitable for said other surface of said one aspect of the present invention, said material comprises a sheet of said material. Said walls, dividers or strips are preferably Integrally formed in said substantially thick sheet. Spacing between one pair of said oppositely positioned dividers, strips or walls preferably range from approximately 3 to approximately 3.5mm and the other pair from approximately 15 to approximately 50mm.

Said partially porous material, or regions of it, may be arranged for different amounts of deformation, and also for differences in other deformation characteristics. For example, said partially porous surface of said surfing device, In one preferred form deforms quickly and the amount of deformation is substantial. In an alternative preferred form said partially porous surface deforms more slowly and the amount of deformation is less. Differences In deformation amounts and other deformation characteristics may be provided, for example by different materials, material thicknesses or densities, or a combination of one or more of these. This deformation, In a preferred form comprises buckling of said walls of said substantially thick sheet. However, in an alternative form, the buckling occurs, for example, in an impact barrier.

Said cables preferably also at least partially absorb a fallen rider's impact. In a preferred form of the present Invention the cables loop under said other surface. The cables are therefore at least partially slack. In the event of said impact of a fallen rider, this slackness enables the cables to at least partially move away from said rider proximal their point of impact. This away movement at least partially absorbs the impact. However, the away movement also results In corresponding movement of said cable on either side of said rider and at least partial lifting of said other surface In regions on said either side. Said lifting preferably also contributes to said impact absorption in a preferred form by preferably lifting at least the weight of said other surface. In a more preferred form of the present invention said cables minimally absorb said fallen rider's Impact and said impact is primarily absorbed by said partially porous surface.

Said deformation is preferably also arranged to at least partially enhance said surfing by temporarily reducing said fluid relief as said surfer surfs over said at least partially porous regions. The fluid relief is preferably temporarily reduced by reducing porosity. In a preferred form of the present invention porosity Is reduced by buckling of said slot edges.

Said energy projecting outlets are preferably spaced substantially evenly. However, due to said shape of said surface effective spacing is at least partially variable for different regions of said virtual surfing surface, The variable nature of said effective spacing creates a resolution effect on said projected energy. This resolution effect alters the effective surface area of projection of said projected energy onto said virtual surfing surface. In preferred embodiments it effectively at least partially alters concentration of projected energy onto said virtual surfing surface.

Said nozzles are preferably spaced in longitudinal direction substantially aligned with said longitudinal length a distance ranging from approximately 50 to approximately 300 mm. Preferably said nozzles are spaced In a direction transverse to said longitudinal direction a distance ranging from approximately 250 to approximately 600 mm. The surfing device preferably comprises between approximately 6 and approximately 60 fluid project nozzles per square metre of the said other surface. Said nozzles are preferably substantially but not entirely round In cross-section. Preferably said nozzles have an effective diameter ranging from approximately 20 to approximately 120 mm.

The fluid projecting nozzles preferably comprise cover means. The cover means is preferably arranged to prevent unwanted particles or objects entering the nozzles. The cover means preferably also prevent parts of a person such as their eyes, fingers or toes from entering the nozzles. Preferably, said cover means comprises gauze. Said gauze preferably has an aperture size ranging from approximately 10square mm to approximately 1000 square mm. Said gauze aperture size may comprise a variety of aperture shapes and Is therefore preferably an effective aperture size.

The energy projecting means is preferably arranged to enable a person to surf upon said virtual surfing surface using an at least partially planar object. Preferably, said planar object further comprises at least one energy receiving region arranged for receipt of said projected energy. Said at least one energy receiving region is preferably adapted for a specific form of energy projected by said energy projecting means. For energy projecting means at least partially arranged for projection of energy in the form of fluid said at least one energy receiving region is preferably at least partially contoured. For energy projecting means at least partially arranged for projection of energy in tne form of electromagnetic radiation said at least one energy receiving region is adapted for absorption of that form of energy. Said latter preferred at least one energy receiving region preferably at least partially comprises metallic or magnetic materials or both magnetic and metallic materials. Said planar object preferably further comprises data means arranged at least for data storage. Said data means is preferably further arranged for data retrieval. In a further preferred embodiment said data means is arranged for real time operation. Said planar object preferably further comprises an at least partially stiff underneath portion. In a more preferred embodiment said planar object further comprises an at least partially soft upper portion. In a preferred form said planar object comprises for example, a surfboard or boogie board having one or more of: said at least one energy receiving region; said at least one contour; said data means; said at least partially stiff underneath portion; and said at least partially soft upper portion. In a preferred form of the present invention comprising energy projecting means In the form of fluid projecting means said substantially planar object further comprises an at least substantially conventional surfboard or boogie board.

One preferred form of said device comprises surfing support means for further supporting said person during said surfing. In one preferred form said surfing support means comprises tether means, for example a cable or rope, which at one end is fixed relative to said virtual surfing surface and at the other end is arranged for holding by said person. More preferably, said energy projecting means is arranged to project energy within a predetermined directional range for at least partially constant tensioning of said tether means during said surfing.

In a still further aspect of the present Invention there is provided a method of enabling surfing comprising the steps of a. providing at least one energy projecting means and at least one corresponding energy projecting structure, said at least one energy projecting structure being arranged to support and position said energy projecting means to provide a plurality of energy projecting positions for projection of energy therefrom and said energy projecting means being arranged to project energy to provide a virtual surfing surface positioned relative to each of said plurality of energy projecting positions a predetermined distance therefrom in a direction of projection of said energy;

b. arranging said energy projecting structure to support and position said energy projecting means to provide said plurality of energy projecting positions; and c. arranging said energy projecting means to project energy from said plurality of energy projecting positions to provide said corresponding virtual surfing surface, and to thereby enable, upon projection of said energy, a surfer to surf at least substantially naturally upon said virtual surfing surface at least partially solely via said projected energy.

Preferably the method further comprises the step of projecting energy from said energy projecting means to enable said surfer to surf at least substantially naturally upon said virtual surfing surface at least partially solely via said projected energy.

Preferably said still further aspect of the present invention further comprises the step of arranging said energy projecting means and energy projecting structure to enable a person to surf at least substantially solely via said projected energy.

Said step of surfing enablement preferably further comprises the step of enabling interaction of said person, or more preferably their surfboard or boogie board, with said projected energy. Preferably, said method further comprises the step of arranging one or more of said energy projecting means and energy projecting structure to simulate an ocean wave. In this more preferred form the method preferably further comprises the step of arranging said surfer to surf at least essentially naturally upon said virtual surfing surface. In a most preferred form said at least essentially natural surfing is essentially equivalent, or even equivalent, to surfing an ocean wave.

In relation to said still further aspect said method more preferably comprises the further step of providing said energy projecting positions proximal said virtual surfing surface.

A more preferred form of said still further aspect of the present invention further comprises the step of providing in relation to said energy projecting means one or more energy projecting outlets.

Said method preferably further comprises the step of arranging said energy projecting means to project fluid. In this preferred form said method preferably further comprises the step of providing energy projecting outlets In the form of nozzles. In an alternative preferred embodiment, said method alternatively comprises the step of arranging said energy projecting means to project an alternative form of energy, for example, electromagnetic energy. In yet another alternative preferred embodiment said method alternatively comprises the step of arranging said energy projecting means to project a combination of one or more of these and suitable alternative non-specified forms of the energy.

One preferred embodiment of said still further aspect of the present invention further comprises the step of at least partially continuously projecting energy in the form of fluid. More preferably this further step comprises substantially solely providing energy projecting means in the form of fluid projecting means. Said one preferred embodiment preferably further comprises the step of providing relief means for removing excess fluid from said surface. In this preferred embodiment said excess fluid is preferably fluid that interacts adversely with said surfing. Said further step more preferably comprises the step of arranging said fluid relief means to modify said surfing. This modification step more preferably comprises the step of modifying said surfing to alter a level of difficulty of said surfing. The step of providing fluid relief means may however further comprise the step of arranging said fluid relief means to alter, for example, one or more of at least the following characteristics of said surfing: drag; fluid projection angle; penetration of said projected fluid.

An at least partially planar object for a surfing device of the type comprising a virtual or actual surfing surface arranged for surfing respectively upon or thereover at least partially solely via direct contact with projected fluid, said planar object comprising at least one fluid receiving region for direct receipt of said projected fluid , wherein said at least one fluid receiving region is arranged to enable a surfer to surf upon said virtual surfing surface or over said actual surfing surface substantially solely via direct contact with said projected fluid.

Preferably said fluid receiving region is further arranged to enable a surfer to surf at least substantially naturally upon said virtual surfing surface or over said actual surfing surface.

The fluid receiving region is preferably at least partially concave. More preferably, the at least partially planar object comprises a plurality of at least partially concave regions which in a still more preferred embodiment collectively comprise a waved surface. Fluid receiving regions of the at least partially concavely shaped end waved surface embodiments are shaped to at least partially enhance uplift provided by the projected fluid.

Said at least one energy receiving region of said planar object of this yet further aspect of the present invention is preferably adapted for a specific form of energy projected by said energy projecting means. Said specific form of energy preferably comprises one or more forms defined in relation to said still further aspect of the present invention and any combination thereof. For energy projecting means at least partially arranged for projection of energy in the form of fluid said at least one energy receiving region comprises at least one contour. For energy projecting means at least partially arranged for projection of energy in the form of electromagnetic radiation said at least one energy receiving region is adapted for absorption of that form of energy. Said latter preferred at least one energy receiving region preferably at least partially comprises metallic or magnetic materials or both magnetic and metallic materials. Said planar object of said still further aspect of the present invention preferably further comprises data means arranged at least for data storage. Said data means is preferably further arranged for data retrieval. In a further preferred embodiment said data means is arranged for real time operation. Said planar object preferably further comprises an at least partially stiff underneath portion. In a more preferred embodiment said planar object of said still further aspect of the present invention further comprises an at least partially soft upper portion. In a preferred form said planar object comprises for example, a surfboard or boogie board having one or more of: said at least one energy receiving region; said at least one contour; said data means; said at least partially stiff underneath portion; and said at least partially soft upper portion. In a preferred form of the present invention comprising energy projecting means in the form of fluid projecting means said substantially planar object of said still further aspect of the present invention further comprises an at least substantially conventional surfboard or boogie board.

Any references in this specification to "surfing" comprise the water sport of skiing.

Australian patent number 777355 and the corresponding patents and patent applications of the applicant referenced earlier herein are hereby incorporated by reference. This incorporation is however not to be taken as an admission that any specification or other document, or excerpt thereof, relating to the patent and corresponding patents and patent applications was common general knowledge in the field relevant to the present invention as it existed in Australia or elsewhere before the priority date of each claim of the present specification. Any documents or excerpts thereof or acts, materials, devices, articles, methods or the like referenced by the patent and corresponding patents and patent applications Is also not to be taken as an admission that these documents, excerpts, acts, materials, devices, articles, methods or the like was common general knowledge in the relevant field to the present invention as it existed in Australia or elsewhere before the priority date of each claim of the present specification. And any description of documents, acts, materials, devices, articles, methods or the like which is included in the present specification is solely for the purpose of either describing the present invention or providing context therefore. It is not to be taken as an admission that any one or more of these descriptions either separately or in combination, or excerpts thereof, forms part of the prior art base or was common general knowledge In the relevant field to the present invention as it existed in Australia or elsewhere before the priority date of each claim of the present specification.

BRIEF DESCRIPTION OF THE FIGURES

A preferred embodiment of the present invention will now be described, by way of example only, with reference to the accompanying figures in which.

DETAILED DESCRIPTION OF THE PREFERRED EMBODIMENT

Figure 1:
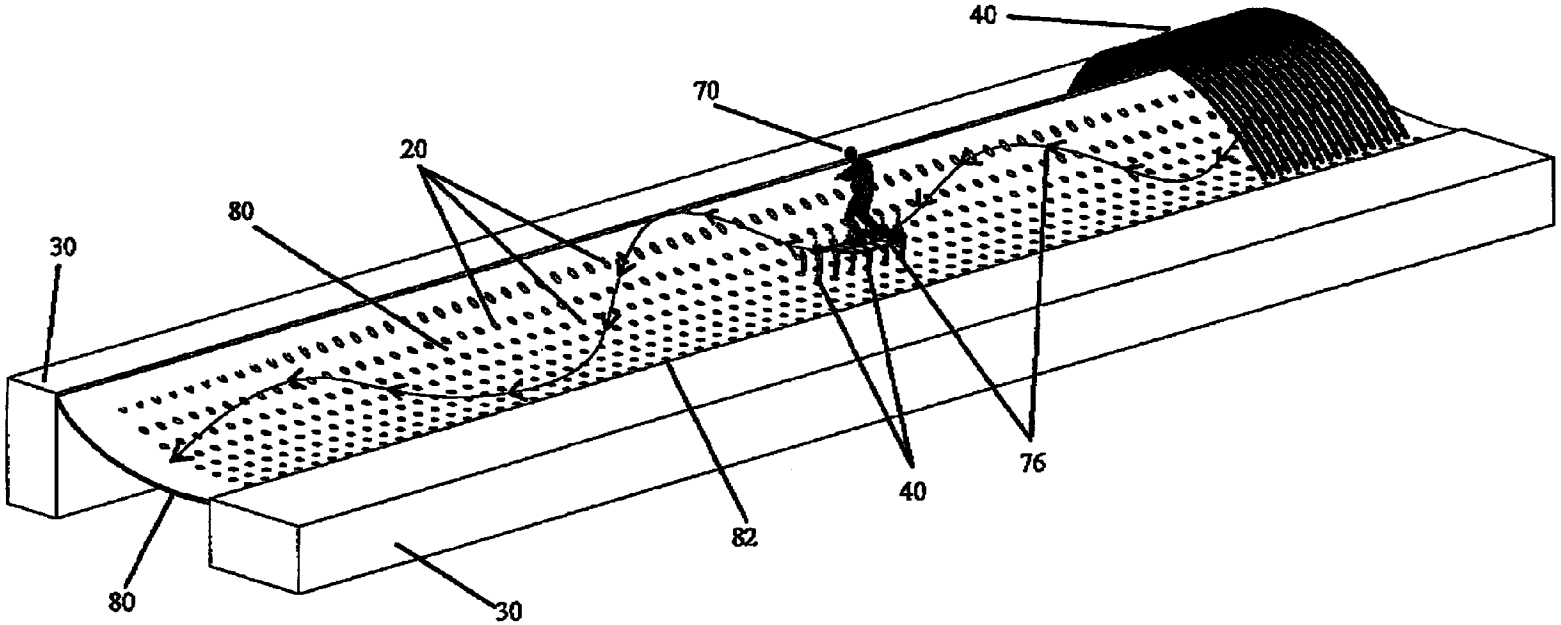
FIG. 1 is a perspective view of en example of a surfing device of the present invention.
Figure 2:
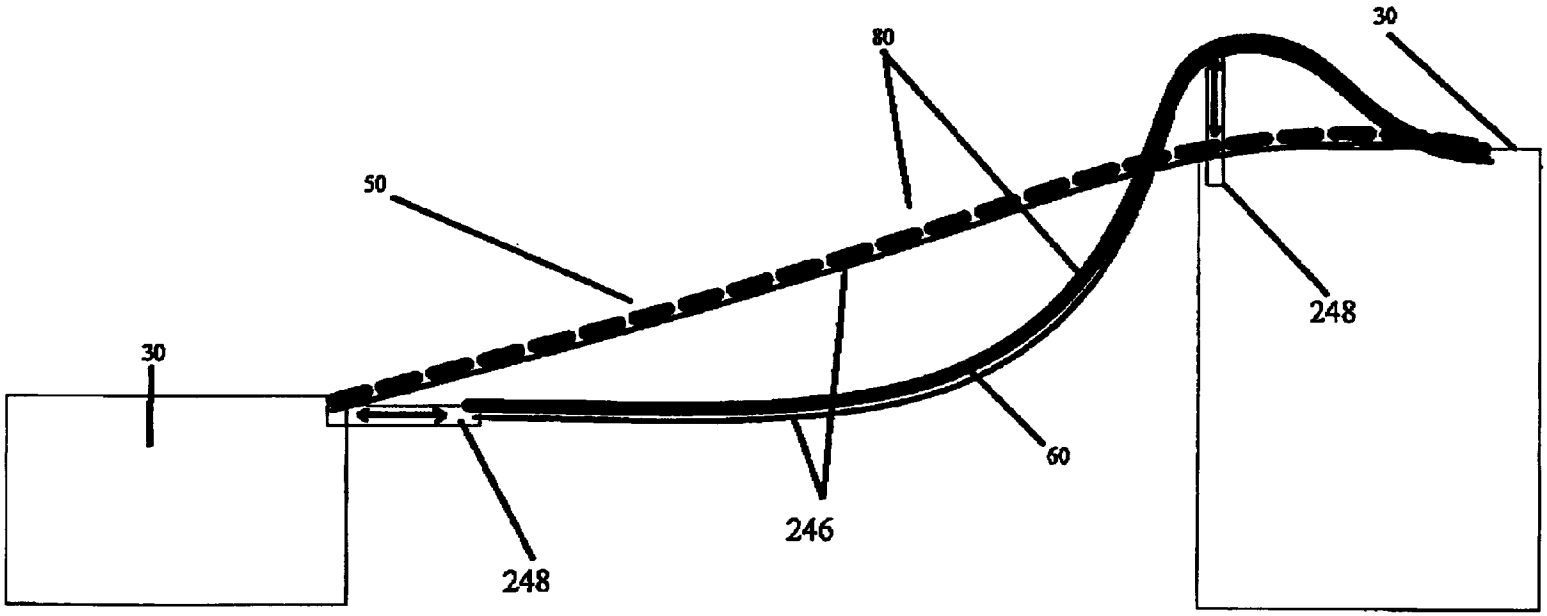
FIG. 2 is a cross sectional view of the device of FIGS. 1 and 1*a;*
Figure 4:
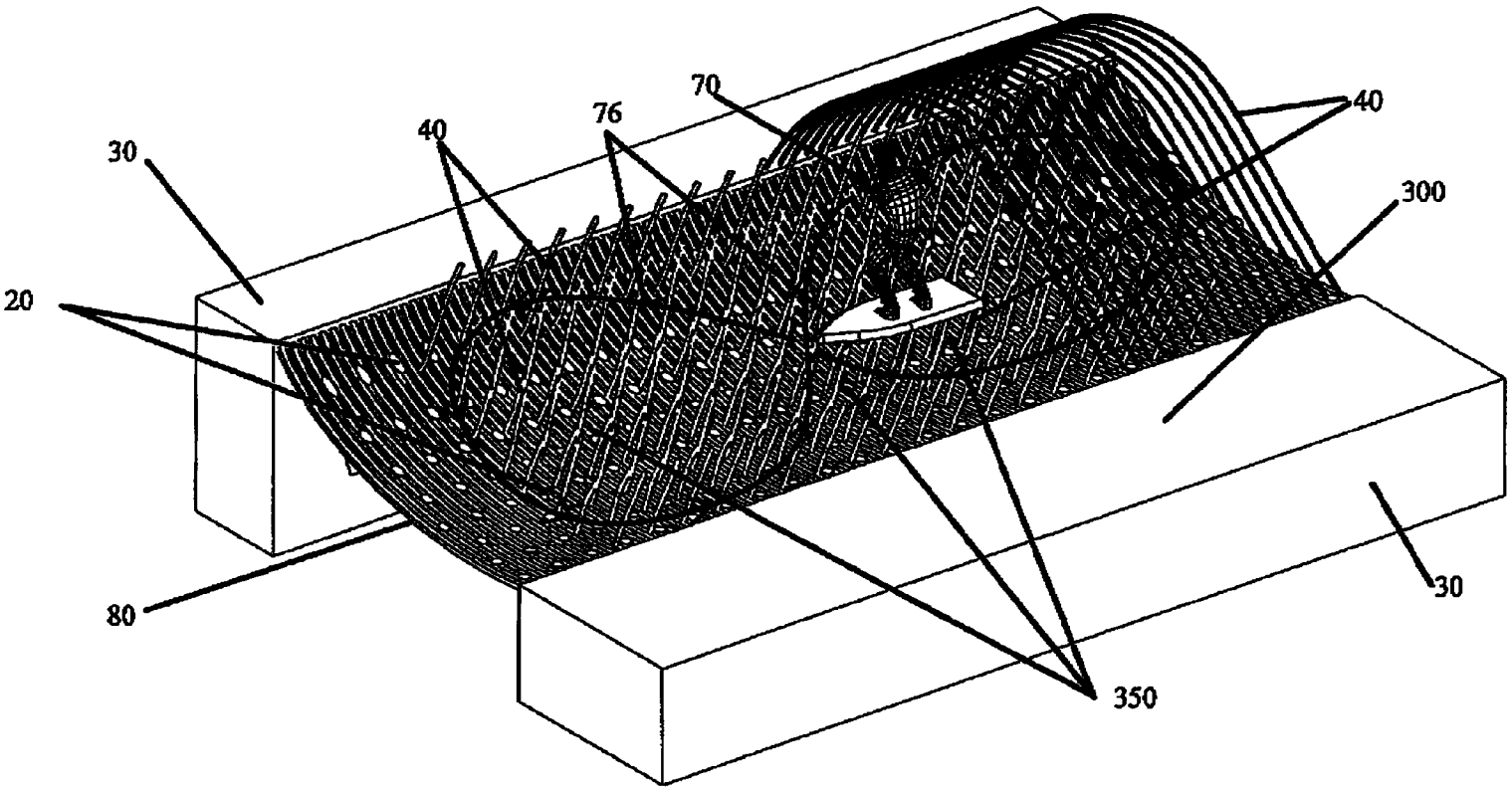
FIG. 4 is a perspective view of an example of a surfing device of the present invention.
Figure 5A:
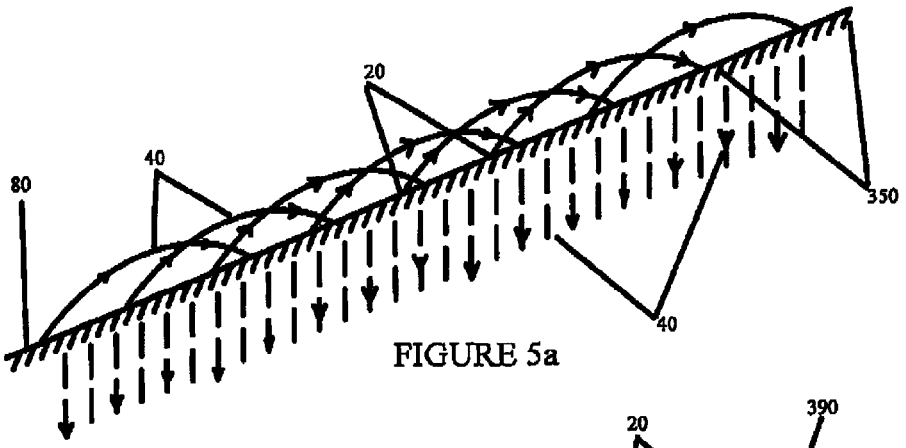
FIG. 5*a* is a cross sectional diagrammatic view of the surfing device of FIG. 4 showing an example of drainage of the present invention.
Figure 5B:
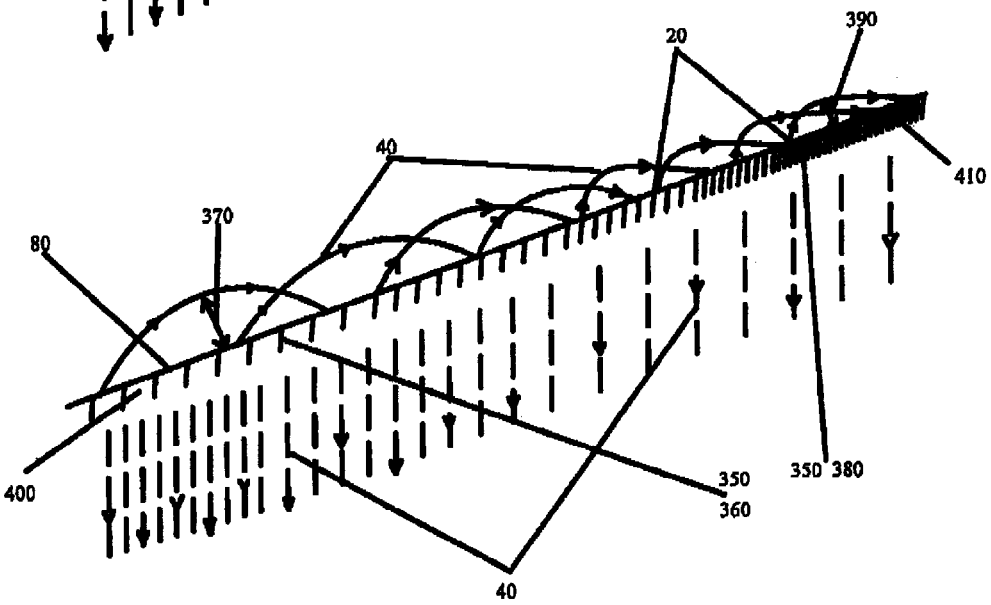
FIG. 5*b* is a cross sectional diagrammatic view of the surfing device of FIG. 4 showing another example of drainage of the present invention.

Referring to FIG. 1, a ride 10 is one example of a preferred embodiment of a surfing device of the present invention comprises at least one energy projecting means in the form of nozzles 20 and at least one energy projecting structure for supporting and positioning the nozzles 20 In the form of support structure 30. In this particular example the nozzles 20 are design to project energy in the form of fluid 40. FIG. 2 shows an example of adjustment that the support structure 30 is capable of between two extreme positions 50 and 60. The nozzles 20 are designed and controlled to project fluid 40 as shown. Projected fluid 40 is on example of fluid projection of the present invention that enables a person 70 to surf 76. In this particular example, the person 70 surfs 76 entirely via direct contact with the fluid 40 and essentially independently of another surface of the present invention which in this particular example comprises surface 80. As can be seen from at least FIGS. 1, 4 and 11, the person 70 surfs at least essentially naturally over the surface 80. This essentially natural surfing Is one example of the present invention of surfing at least substantially naturally. In a most preferred form this essentially natural surfing is essentially equivalent, or even equivalent, to surfing an ocean wave. Surface 80 is formed of PVC. The nozzles 20 project fluid 40 from a position which lies essentially in a plane of the surface 80.

Figure 1A:
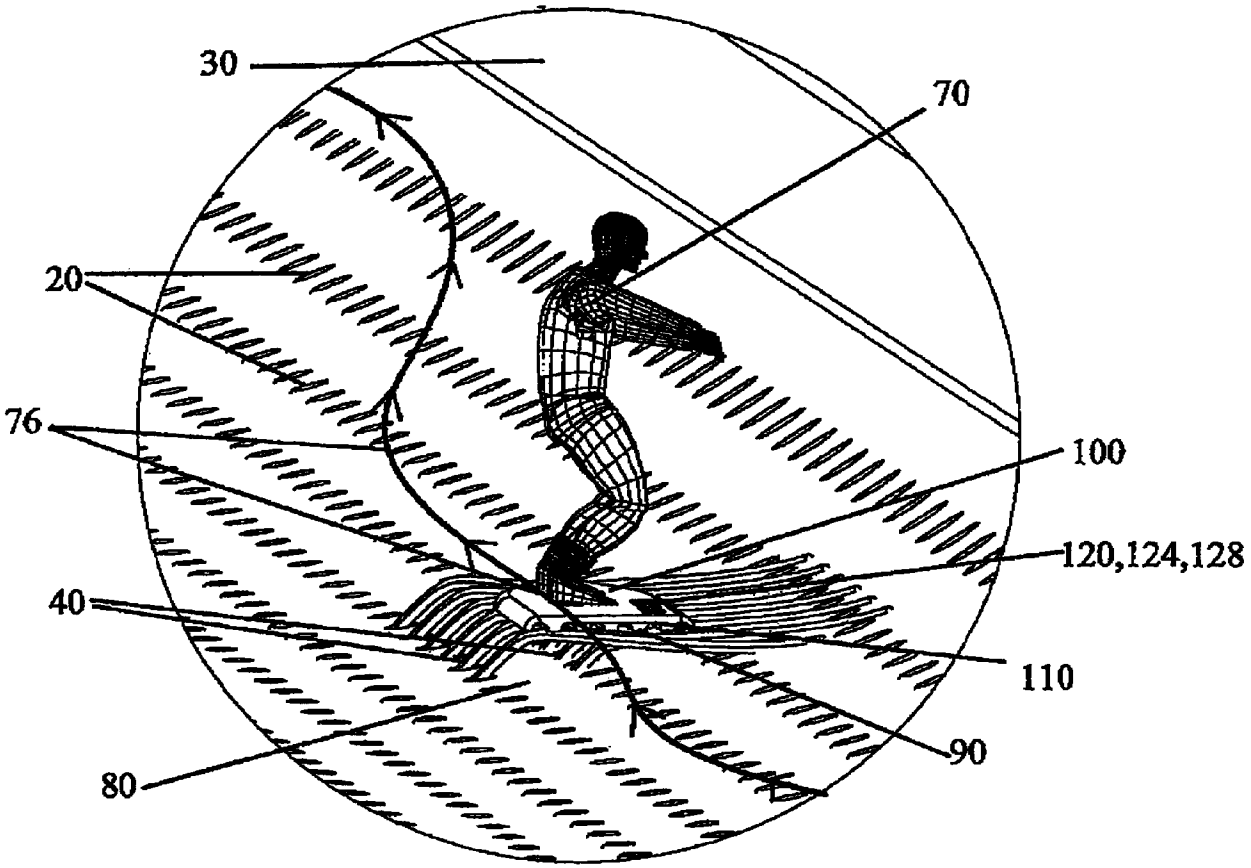
FIG. 1*a* is a perspective view of a portion of the device of FIG. 1.

The person 70 is enabled to surf 76 upon a virtual surfing surface of the present invention In the form of surface 90 as follows. Referring to FIG. 1*a*, surfing 76 involves a planar object which In this particular example is in the form of surfboard 100. The surfboard 100 has an appearance which closely resembles a conventional surfboard with differences explained below. Interaction between the fluid 40 and an underneath surface 110 of the surfboard 100 enables the person 70 to surf 76 upon the surface 90. The surface 90 of this particular example is positioned above the surface 80. The surfer 70 surfs 76 upon the surface 90 and over the surface 80 essentially without making any significant contact with the surface 80. The surfer 70 therefore surfs 76 essentially free from any friction that would otherwise result from contact with the surface 80.

The surfboard 100 Includes contours of the present invention which in this particular example comprise a waved underneath surface 110. Also Included in the surfboard 100 are data means in the form of a processor 120 and corresponding respective data receiving and emitting terminals 124 and 128. As will be readily appreciated by a person skilled in the relevant art emitting terminals 128 enable recorded data to be retrieved and analysed. The processor 120 and terminals 124 and 128 of this particular embodiment is also designed for real time operation. The surfboard 100 also includes an at least partially stiff underneath portion which in this particular example is in the form of stiffened portion 134. A softened portion 136 Is also included and is one example of an at least partially soft upper portion.

Figure 3:
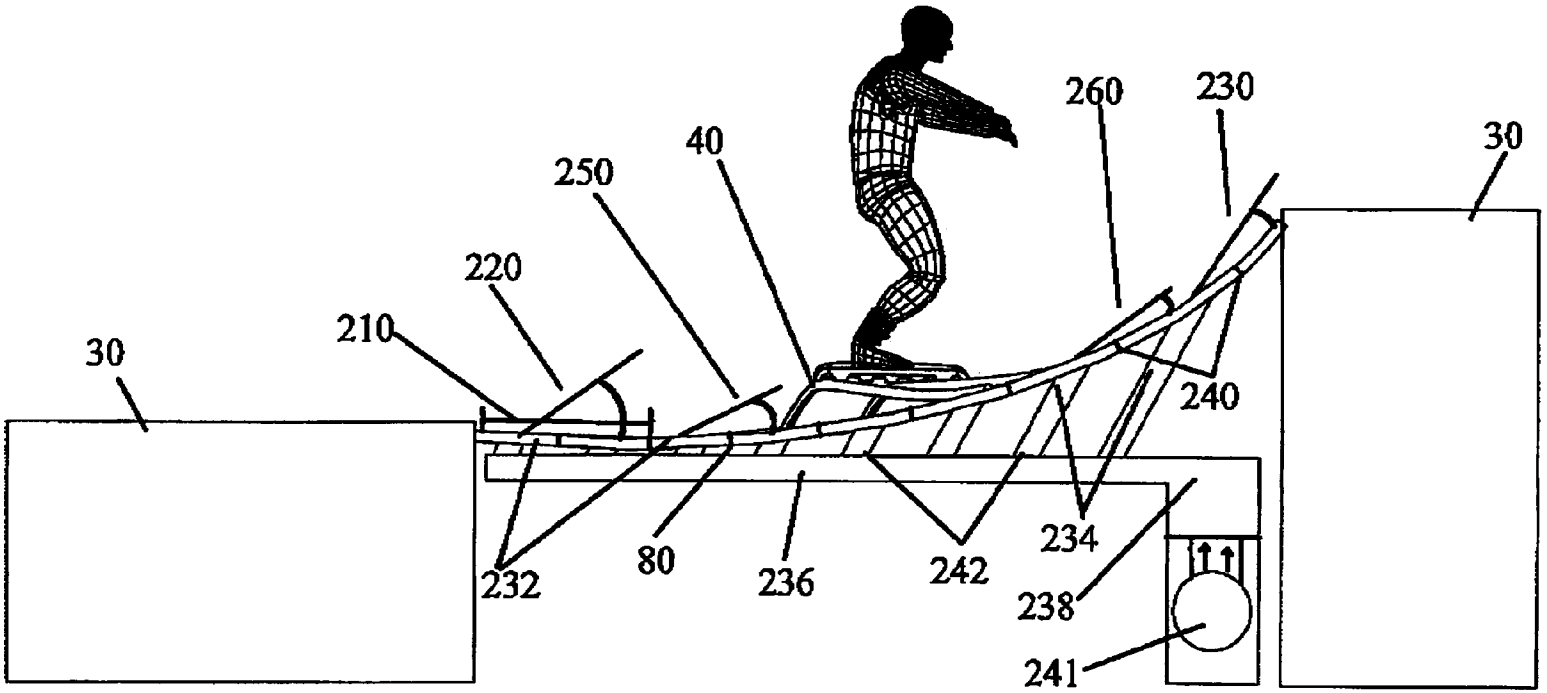
FIG. 3 is a cross sectional view of alternative examples of a surfing device of the present invention.

As can be best seen in FIG. 3, the nozzles 20 and support structure 30 of this particular example are designed to simulate an ocean wave 200. The nozzles 20 are positioned in space and relative to each other to project fluid from energy projecting positions of the present invention which in this particular embodiment comprises uniform or semi-uniformly spaced fluid projecting positions 22 of the surface 80. The projected fluid directs energy outwardly of the surface 80 from a position which can either be on or below the surface 80. Fluid is projected with sufficient force to enable a rider using a planar object such as surfboard 100 to ride mostly free of any frictional forces that would otherwise occur between the surfboard 100 and the surface 80.

Fluid 40 is projected at an angle ranging from approximately 10 to approximately 35 degrees relative to a tangential plane which is tangential to the surface 80, and values ranging from approximately 150kgf per square meter to approximately 500kgf per square meter. However, mostly the fluid 40 is projected generally uniformly both In terms of the angle and force of projection. The device 10 is however designed so that It can include segments (see for example FIG. 3 and segment 210 of that figure) that project fluid 40 at angles and forces generally different to those of other segments of the device 10. This variation enables the device 10 to more exactly simulate different surfing conditions experience at different points on a natural ocean wave. The respective range of projection angles described above Is represented by lines 230 and 220 respectively of FIG. 3.

Figure 7:
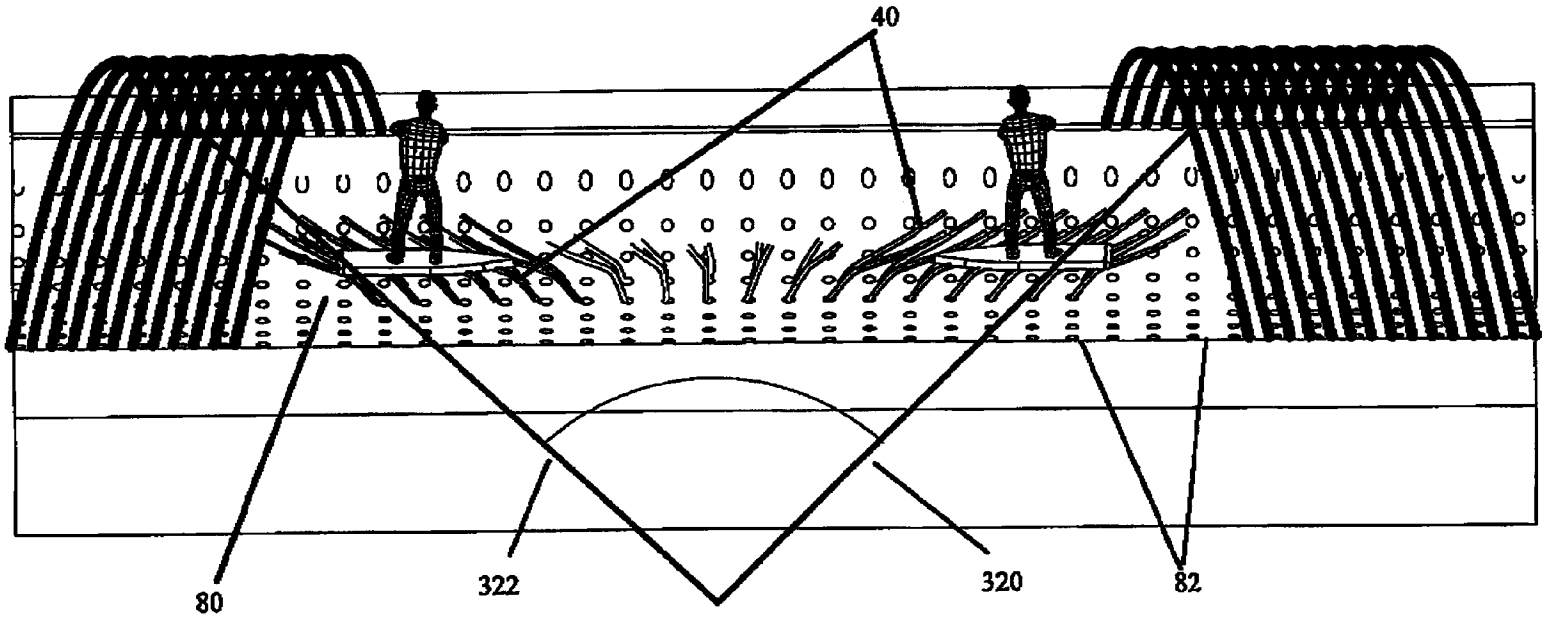
FIG. 7 is a front elevational view of the examples of a surfing device of the present invention of FIGS. 1 and 4.
Figure 8:
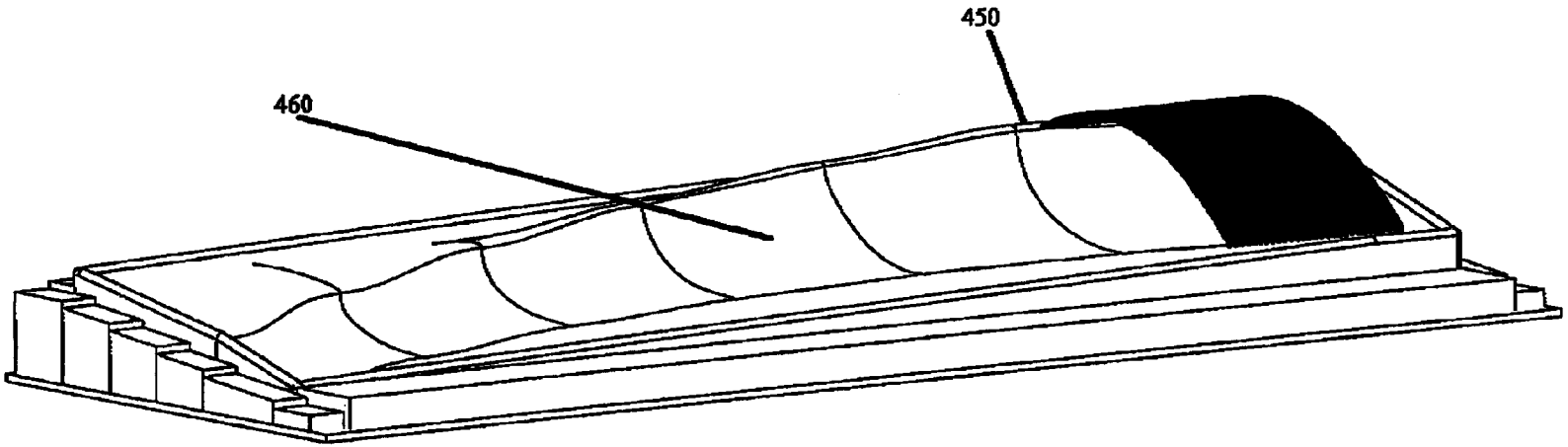
FIG. 8 is a perspective view of en example of a surfing device of the present invention.

As is best shown in FIG. 7, fluid 40 is also projected at a range of angles between approximately 135 and approximately 45 degrees relative to a front edge 82 of the surface 80. These angles are represented by lines 320 and 322 respectively. This second group of projection angles further enables the ride 10 to more exactly simulate real wave effects. Real wave effects alter dynamics of surfing and the surfing device 10 is designed to simulate these effects to, for example, make the device 10 easier or more difficult to longitudinally traverse. This adjustment of the level of difficulty is, for example, made by increasing or decreasing drag of the surfboard 100. Real wave effects are also enhanced by dynamic adjustment of both groups of projection angles described above so that the angles can be adjusted while the ride is operating. The surfing device 10 also has the capability of static adjustment of both groups of projection angles in which case angles of projection are adjusted when the device 10 in not In use.

The surfing device 10 is designed for essentially non-continuous projection of fluid from nozzles 20 during operation. This fluid projection is as described in relation to the above referenced present applicant's patent 777355 and relies on sensors and related features described therein. Those sensors and related features are hereby incorporated by reference.

The surface 80 is modular and constructed of connected modules 232. Modules 232 each have nozzle housings 234 for receipt and housing of nozzles 20. The device 10 includes an energy projecting structure in the form of structure 236, which in this particular example, is designed for projecting the fluid 40. The structure 236 includes structural members in the form of structural members 238 which connect to form structure 236.

Each module 232 of this particular example also Includes connecting means, for example, in the form of nuts and bolts or crimps, ties, and clips, as well as other types of fasters 240 for mechanical connection, and also fittings 242. The connecting means may also additionally or alternately comprise chemical connections, comprising for example, heat bonding, ultrasonic welding or gluing or a combination of these. Mechanical connections comprise at least one or more of the following: suction or a vacuum; gravity; or centrifugal force.

Figure 6:
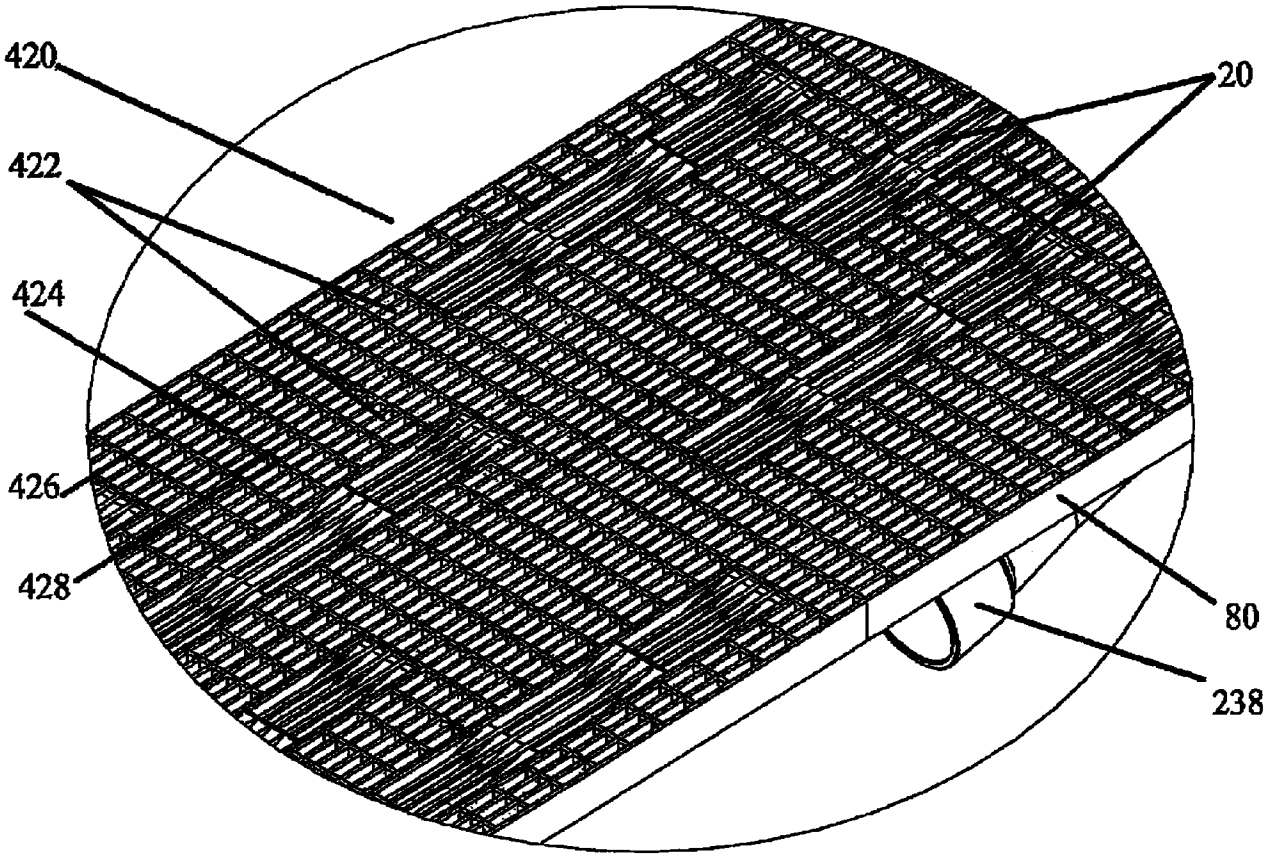
FIG. 6 is a perspective view of another example of drainage of the surfing device of FIG. 4.

As is best shown In FIG. 6, a preferred embodiment of the other surface of the present invention is at least partially porous to facilitate drainage and this takes the form in relation to surface 80 of slotted or gauzed PVC 420. The slotted PVC 420 has a fluid relief or drainage ratio which corresponds to that of the present invention which is a ratio of surface area of said other surface that is fluid permeable relative to the remainder of the surface area of said other surface that is not fluid permeable. With respect to the slotted PVC 420 its fluid relief ratio is approximately 0.52 sqm per sqm. Consistent with the corresponding ratio calculation in relation to the present invention, this ratio is calculated from the ratio of the surface area of surface 80 that Is fluid permeable relative to the remainder of the surface area of surface 80. Slots 422 of the slotted PVC 420 are formed by two corresponding pairs of oppositely positioned walls 424 and 426 that collectively define rectangular shaped apertures 428. One pair of the oppositely positioned walls 424 are spaced from each other ranging from approximately 3 to approximately 15mm, and the other pair 426 from approximately 15 to approximately 50mm.

Figure 6A:
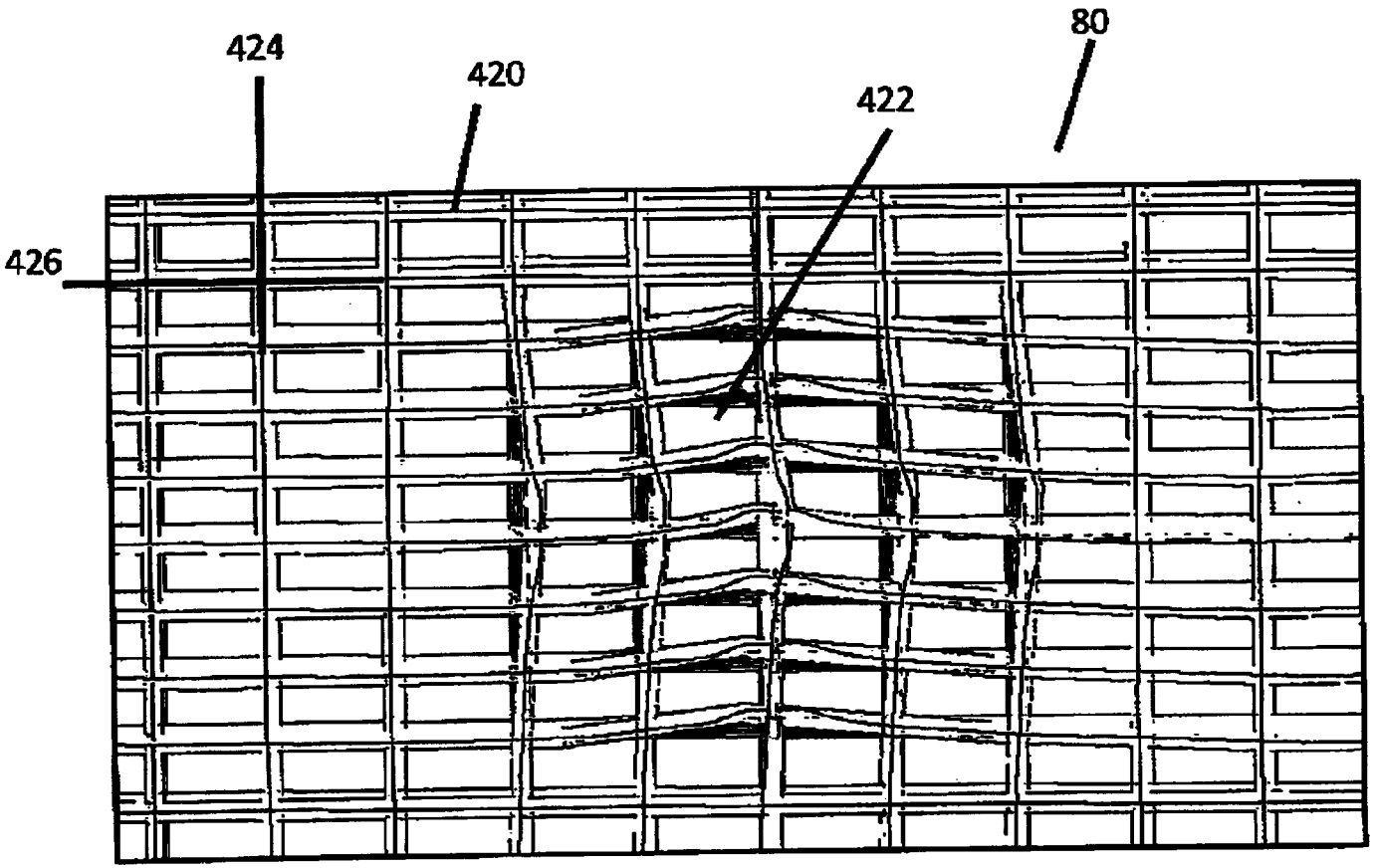
FIG. 6*a* is a schematic plan view of one example of the other surface of the surfing device.
Figure 6B:
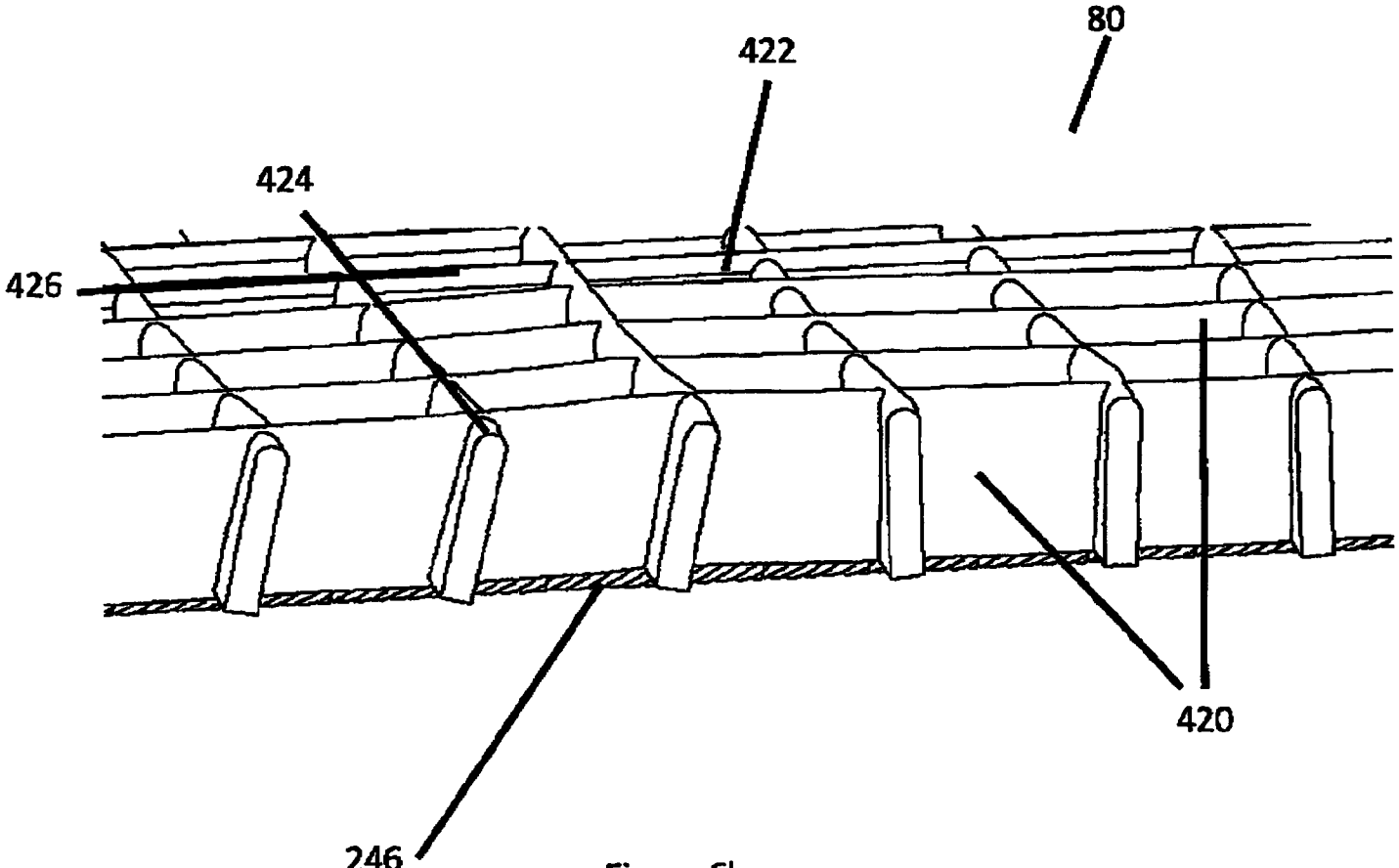
FIG. 6*b* is a perspective view of the other surface of FIG. 6*a;*

Referring to FIG. 6*a*, the partially porous surface of the slotted PVC 420 is designed to deform upon impact of a fallen rider to absorb the rider's energy and enhance ride safety. The walls 424 and 426 of the slotted PVC 420 deform by buckling. They are designed to buckle quite instantaneously upon impact to provide a soft feeling for a fallen rider. The slotted PVC 420 is approximately 50 mm thick, and therefore quite thick. As such, although the walls 424 and 426 buckle quite quickly they are capable of absorbing most of the energy generated during a rider's fall. However, energy absorption can also be adjusted by using different materials, material thicknesses, densities, or a combination of one or more of these.

The slotted PVC 420 is also applicable to water sport related rides other than those of the detailed description, for example ride 10. The surface 80, is designed for a person to surf on either via the projected fluid of, for example, ride 10, or alternatively, by at least partially direct contact with the slotted PVC 420 and via fluid projected out of, over or upon the slotted PVC 420.

Figure 6C:
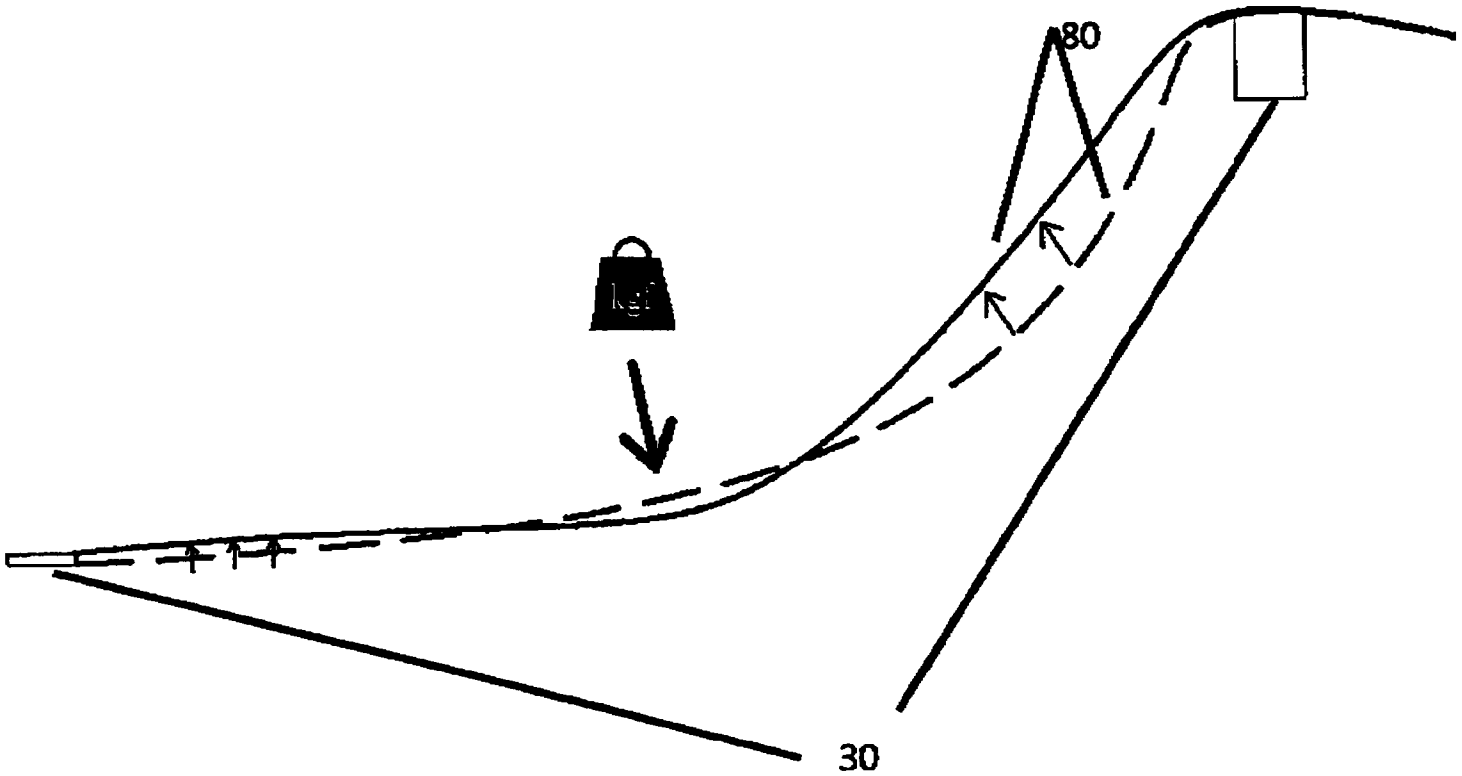
FIG. 6*c* is a schematic side elevational view of the other surface of FIGS. 6*e* and 6*b;*
Figure 6D:
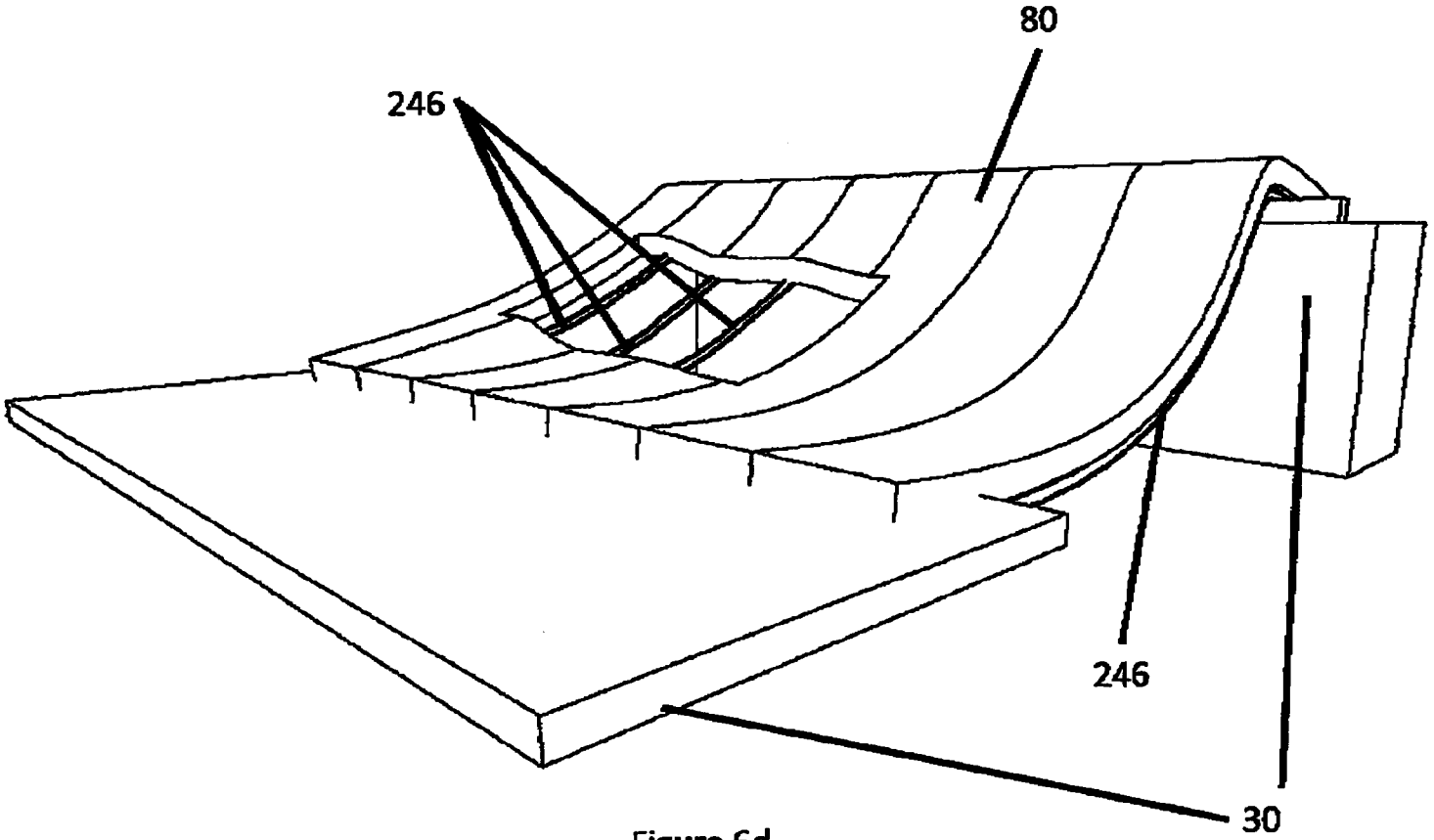
FIG. 6*d* is a schematic perspective view showing supporting cables of the surfing device.

The cables or straps 246 also absorb a fallen rider's impact. FIG. 6*d* shows the cables 246 looping under the surface 80. Refering to FIG. 6*c*, the:cables 246 are slack enough, in the event of a rider falling onto the surface 80, to at least partially move away from the rider proximal their point of Impact 427 and absorb some of the impact. This away movement also results in corresponding movement of the cables or straps 246 on either independently adjustable relative to other of these adjustable features and also relative to position of the surface 80. This enables different values to be set at any given time at different positions. The static and dynamic adjustment corresponds to static and dynamic fluid relief adjustment described above in relation to the surfing device 300. It also includes automatic adjustment control corresponding to manual and automatic fluid relief adjustment which is also described above.

Referring to FIGS. 1-4 surfing devices 10, 300 and 450 are also designed for static adjustment of the following: position of nozzles 20 and the corresponding fluid projecting positions 22; and fluid projection of nozzles 20 including their fluid projection capacity. This static adjustment corresponds to static fluid relief adjustment described above. The surfing devices 10, 300 and 450 also optionally Include manual and automatic adjustment control corresponding to manual and automatic fluid relief adjustment control described above.

Figure 9:
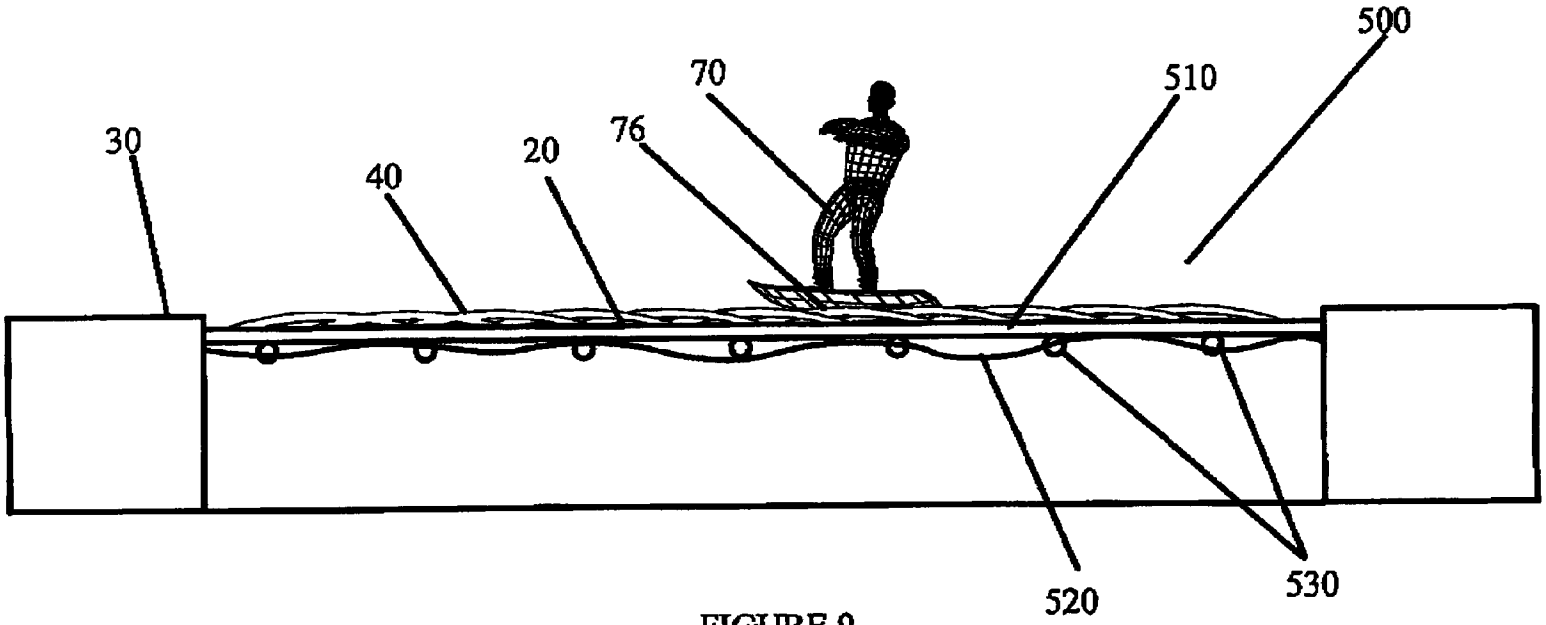
FIG. 9 is a cross sectional view of an example of a surfing device of the present invention.

FIG. 9 shows another example of a surfing device of the present invention in the form of surfing device 500. surfing device 500 includes, in place of surface 80 of surfing devices 10, 300 and 450, a horizontal and flat surface 510. Surface 510 Is supported on top of or just beneath a body of fluid in the form of liquid 520, or alternative, up to approximately 300 mm below an upper surface of the body of liquid 520. The surfing device 500 also includes surface 90 of the surfing devices 10, 300 and 450. Surface 90 of the surfing device 500 is as described in relation to the surfing devices 10, 300 and 450.

The surfing device has at least one floatation means in the form of floats 530. The floats 530 are connected to the surface 510 and designed for its support upon the liquid 520.

The surfer 70 surfs 76 over the surface 510 of the surfing device 500 without making any significant contact with the surface 510. The surfer 70 therefore surfs 76, as in relation to surfing device 10, over the surface 510 essentially free from any friction that would otherwise result from contact with that surface.

The surfer 70 also surfs 76 In a manner, as described in relation to the surfing devices 10, 300 and 450, that is essentially natural and in a most preferred form In a manner that is essentially equivalent, or even equivalent, to surfing an ocean wave. However, surfing 70 using the surfing device 500 also differs from surfing 76 using the surfing devices 10, 300 and 450. It differs because it requires surfing support means of the present invention which in this particular example comprises a tether in the form of a rope 535. The rope 535 is designed to further support the surfer 70 during surfing 76 and is fixed at one end 537 relative to the surface 510 and at the other end 539 is held by the surfer 70. The reason the surfing device 500 requires, In this particular example, the rope 535 is described below. First, it is necessary to describe another difference between the surfing device 500 and the surfing devices 10, 300 and 450.

Nozzles 20 of the surfing device 500 project fluid 40 as described in relation to the surfing devices 10, 300 and 450 with one exception. The nozzles 20 of the surfing device 500 are all angled to project fluid 40 in a predetermined directional range of the present invention which in this particular example comprises a single general direction. For example, in relation to the surfer 70 of the surfing device 500 the nozzles 20 are directed to project fluid 40 in a direction which forces the surfer 70 away from the direction that he or she is facing.

The projection of fluid 40 described above in relation to the surfing device 500 enables the surfer 70 to interact with the projected fluid 40 in a manner similar to that also described above in relation to the surfing devices 10, 300 and 450 and surf 76 over the surface 510. However, because the surface 510 is horizontal and flat surfing 76 in relation to the surfing device 500 is only possible, in relation to this particular example, when the rope 535 is held by the surfer 70 via end 539. By holding the rope 535 in this manner the surfer 70 maintains his or her position against the force of projected fluid described above, in doing so the rope 535 becomes taut, as a result of one example of the present invention of at least partially constant tensioning, and the corresponding tension in the rope 535 enables the interaction described above.

Figure 10:
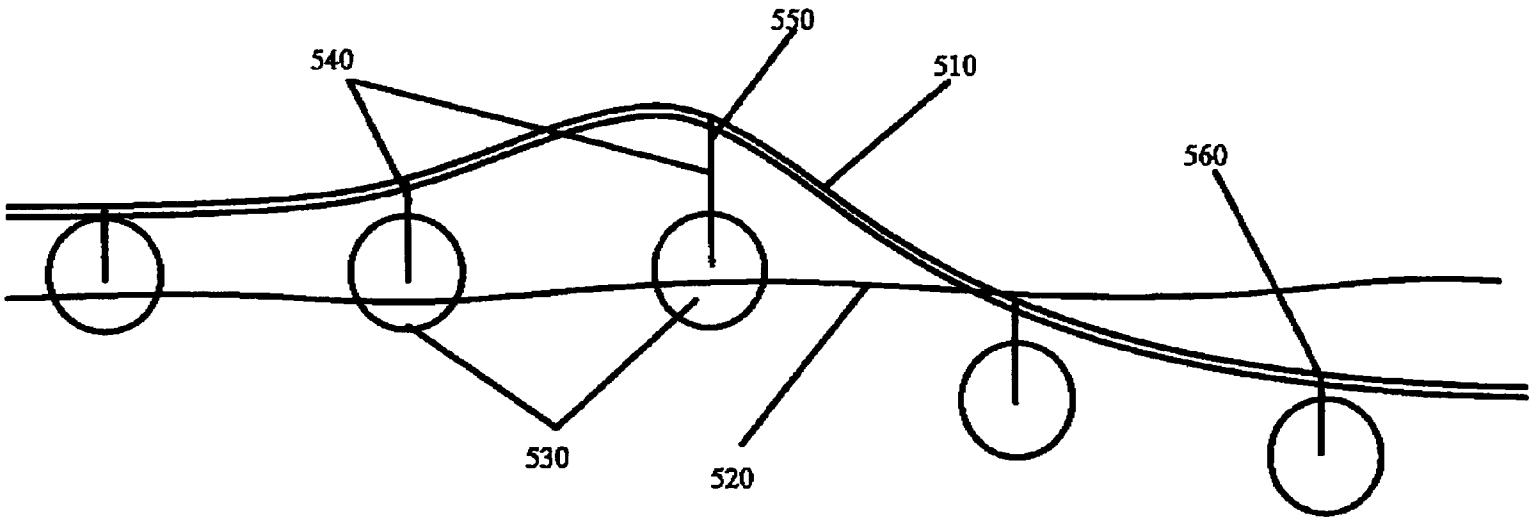
FIG. 10 is cross sectional view of the example of a surfing device of the present invention of FIG. 9 showing adjustment diagrammatically.

The floats 530 include static adjustment of the present invention in the form of static adjustment 540. This static adjustment enables adjustment between extreme float positions 550 and 560 of FIG. 10.

Figure 11:
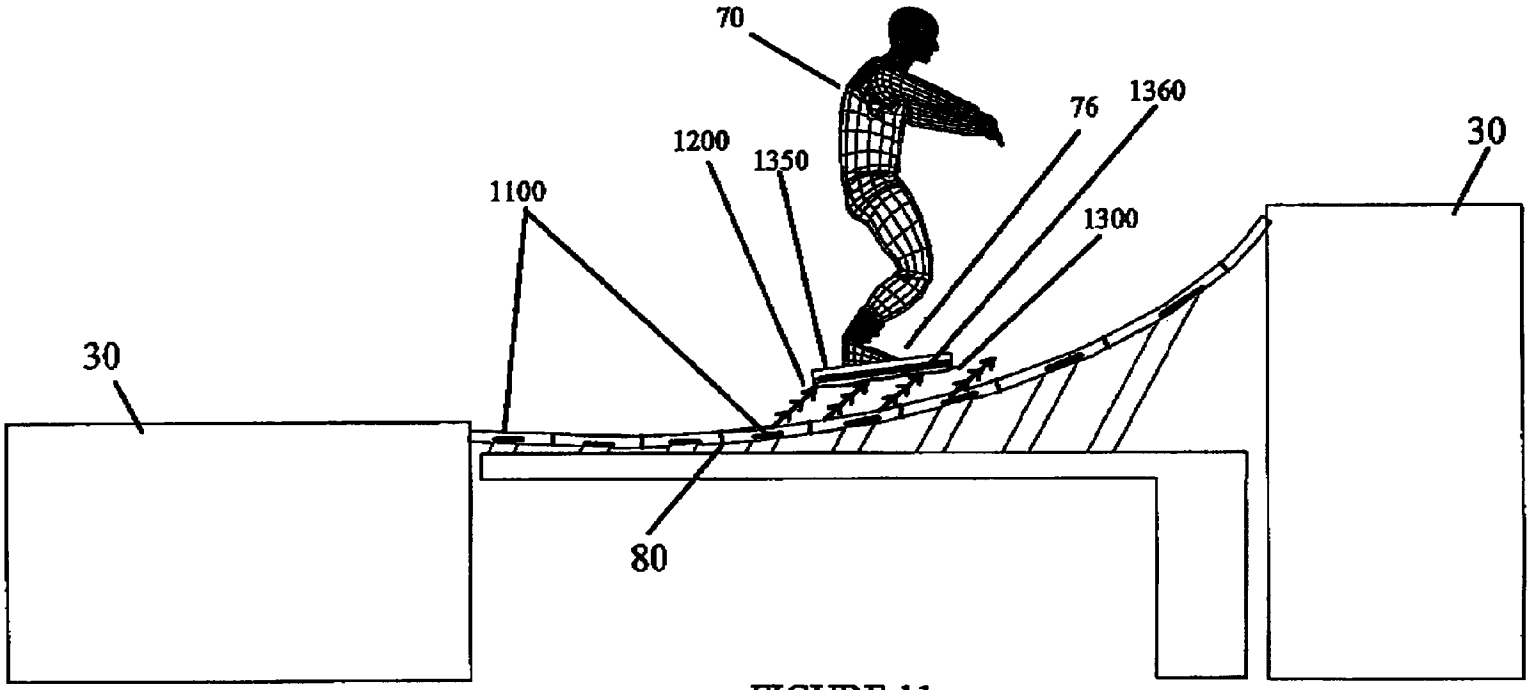
FIG. 11 is a cross sectional view of another example of a surfing device of the present invention.

Another example of a surfing device of the present invention is surfing device 1000 shown In FIG. 11. This other example comprises at least one energy projecting means in the form of electromagnetic energy projecting plates 1100. It also includes the support structure 30 of the surfing devices 10, 300 and 450 along with all other features of the surfing device 10. Other features of the surfing device 1000 that are identical to those of the surfing device 10 are referenced using reference numerals used in relation to the surfing device 10. Arrows 1200 represent electromagnetic energy projected by the plates 1100. Projected electromagnetic energy 1200 is another example of energy projection of the present invention that enables a person 70 to surf 76. As explained above in relation to the surfing device 10, in this other example, the person 70 surfs 76 entirely via direct contact with the projected energy 1200 and essentially independently of surface 80. The plates 1100 project electromagnetic energy 1200 from energy projecting positions of the present invention which In this particular embodiment comprise electromagnetic energy projecting positions 1250 which lie essentially in a plane of the surface 80.

With respect to surfing device 1000 the person 70 surfs 76 upon a virtual surfing surface of the present invention in the form of surface 1300 as follows. Referring to FIG. 11, surfing 76 involves a planar object in the form of surfboard 1350. The surfboard 1350 has an appearance which closely resembles surfboard 100. However the surfboard 1350 doesn't include the waved underneath surface 110 of surfboard 100. In place of the waved underneath surface 110 it has at least one electromagnetic energy receiving region in the form of metallic plates 1360. The surfboard 1350 is designed in relation, for example, to its shape and materials to best receive the electromagnetic energy 1200. The design of the surfboard 1350 may also be adjusted according to user preferences, for example shape, thickness, weight, texture, stiffness. The electromagnetic energy has a concentration ranging from approximately 150kgf per square meter to approximately 500kgf per square meter. This energy range relates to an active area of the surface 80 which is that area of the surface 80 which at any given instant is intended for the person 70 to surf 76 over.

Interaction between the electromagnetic energy 1200 and the metallic plates 1360 enables the person 70 to surf 76 upon the surface 1300. As in relation to the surfing device 10, the surface 1300 of the surfing device 1000 is positioned above the surface 80. The surfer 70 surfs 76 upon the surface 1300 without making any significant contact with the surface 80. The surfer 70 therefore surfs 76, as in relation to surfing device 10, over the surface 80 essentially free from any friction that would otherwise result from contact with the surface 80. The surfer 70 also surfs 76 in a manner, as described in relation to the surfing device 10, that is essentially natural and in a most preferred form in a manner that is essentially equivalent, or even equivalent, to surfing an ocean wave.

It will be appreciated that the Invention in at least one of its preferred forms has at least the following advantages:

1. Provision of a simulated wave which is adjustable in real time while a person surfs via it;
2. Adjustability of a simulated wave including for example angle and force of said projected energy and also in relation to any region of the surfing device or precise position of, or above, said other surfing surface of the surfing device upon which a person surfs;
3. Adjustabliity of a simulated wave to simulate many and varied natural ocean waves to suit all skill levels. Adjustability, Including for example in relation to features of item 2 immediately above, different wave directions and energy levels in relation to any region or precise position as referenced at item 2 immediately above is vast and possibly infinite. As such, different simulated waves that can be experienced with one or more embodiments of the surfing device are also vast and possible infinite. These different simulated waves and different simulated wave experiences can also occur in relation to the same surfing device embodiment. Adjustment between these different simulated waves and different simulated wave experiences can also occur dynamically while a surfer is surfing the surfing device, and also in real time;
4. Efficient transfer of energy to a surfing device such as a surf board or boogie board for efficient energy and power consumption. This is provided, for example, in relation to at least one preferred embodiment because energy is projected from a position which is proximal that of a person surfing on the device at any given instant in time, in relation to this preferred embodiment, and at least one other, energy transfer is more efficient than other wave simulation devices providing similarly sized simulated waves. These other wave simulation devices typically comprise either or both projection of fluid onto a ride surface or provision of a stream of fluid. Both result in significant frictional forces and these typically rapidly reduce fluid velocity. Other wave simulation devices therefore typically require significantly more energy in order to overcome these frictional forces.
5. Relief of fluid from said other surfing surface of the surfing device above which a surfer surfs. This relief enables adjustment of interference of residual fluid with, either or both, the projected fluid or a surfer surfing via the surfing device. It can therefore be used to adjust fluid dynamic aspects of the surfing device to in turn adjust ride characteristics of the device such as those described in relation to the aforementioned advantages. This fluid relief can also be provided in relation to any region of the surfing device or precise position of, or above, said other surface of the surfing device of the present invention. It can also at least substantially quickly adjust interference. Constant and generally even fluid relief provides another advantage of preventing fluid building up as, for example, a wave upon said other surface. This limits load bearing requirements of the corresponding support structure and facilitates a corresponding reduction in support structure construction requirements. It also facilitates more flexible design limitations in relation to the surfing device. This increased flexibility leads, for example, to improvements in impact absorption design and reductions In construction costs compared to other wave simulation devices. Further advantages associated with fluid relief relate to safety whereby fluid can be instantaneously drained from the other surface of the present invention if so required by an operator to ensure the safety of a participant.
6. Impact absorption by: localised deformation of said other surface; looped support cables designed to move away from the point of impact to at least partially assist in impact absorbtion; movement of said other surface into a body of fluid; or a combination of one or more of these.

It will be appreciated by persons skilled in the art that numerous variations or modifications may be made to the invention as shown in the specific embodiments without departing from the spirit or scope of the invention as broadly described. For example, energy projection may, for example, comprise a combination of fluid and electromagnetic energy projection. The proportion of each form of energy may also be designed to provide the most efficient form of energy transfer to a planar object such as surfboard 100. The present embodiments are, therefore, to be considered in all respects as illustrative and not restrictive.

The invention claimed is:

1. A surfing device comprising at least one energy projecting means and at least one corresponding energy projecting structure, said at least one energy projecting structure being arranged to support and position said energy projecting means to provide a plurality of energy projecting positions for projection of energy therefrom and said energy projecting means being arranged to project energy from said plurality of energy projecting positions to provide a virtual surfing surface positioned relative to each of said plurality of energy projecting positions a predetermined distance therefrom in a direction of projection of said energy, wherein said energy projecting means is arranged to project said energy from said energy projecting positions to enable a surfer to surf at least substantially naturally upon said virtual surfing surface at least partially solely via said projected energy.

2. A surfing device as claimed in claim 1 wherein said energy projecting means and energy projecting structure are arranged to enable said surfer to surf at least substantially solely via said projected energy.

3. A surfing device as claimed in claim 1 wherein said energy projecting means is further arranged to project energy from a position proximal said virtual surfing surface.

4. A surfing device as claimed in claim 3 wherein said proximal position is substantially marginally removed from said virtual surfing surface.

5. A surfing device as claimed in claim 3 wherein said proximal position is removed from said virtual surfing surface by a distance ranging from approximately 5 mm to approximately 50 mm.

6. A surfing device as claimed in claim 1 wherein said energy projecting means is arranged to project fluid.

7. A surfing device as claimed in claim 6 wherein said energy projecting means comprises nozzles.

8. A surfing device as claimed in claim 1 wherein said energy projecting means is arranged to project energy at values ranging from approximately 1,470.9975 Pa (150 kgf per square meter) to approximately 4,903.325 Pa (500 kgf per square meter).

9. A surfing device as claimed in claim 1 wherein said energy projecting means is arranged to project energy in relation to one or more of said energy projecting positions, at an angle ranging from approximately 5 to approximately 35 degrees relative to a tangential plane which is tangential to said virtual surfing surface.

10. A surfing device as claimed in claim 9 wherein said energy projecting angle is adjustable, in relation to one or more of said energy projecting positions and independently of none or one or more of the other said energy projecting positions, either statically or dynamically or both statically and dynamically.

11. A surfing device as claimed in claim 1 wherein said surface is elongate and arranged for surfing at least generally along a longitudinal length of said elongate surface.

12. A surfing device as claimed in claim 11 wherein said energy projecting means is arranged to project energy, in relation to one or more of said energy projecting positions, at an angle ranging from approximately 45 degrees to approximately 135 degrees relative to a longitudinal edge of said elongate surface.

13. A surfing device as claimed in claim 12 wherein said energy projecting angle is adjustable, in relation to one or more of said energy projecting positions and independently of none or one or more of the other said energy projecting positions, either statically or dynamically or both statically and dynamically.

14. A surfing device as claimed in claim 1 wherein said virtual surfing surface is shaped for said surfing to at least partially simulate surfing of an ocean wave.

15. A surfing device as claimed in claim 1 wherein at least one or more of the following features are adjustable, in relation to one or more of said energy projecting positions and independently of none or one or more of the other said energy projecting positions, either statically or dynamically or both statically and dynamically: said amount of energy projected from one or more said energy projecting positions; a position in space of one or more said energy projecting positions; a position in space of said virtual surfing surface proximal one or more said energy projecting positions; a shape of said virtual surfing surface proximal one or more said energy projecting positions.

16. A surfing device as claimed in claim 1 wherein at least a portion of said virtual surfing surface is substantially horizontal.

17. A surfing device as claimed claim 16 wherein said at least substantially horizontal portion is substantially flat.

18. A surfing device as claimed in claim 16 wherein at least a portion of said virtual surfing surface is at least partially submerged within a body of fluid.

19. A surfing device as claimed in claim 18 further comprising at least one floatation means arranged for supporting said device via said body of fluid.

20. A surfing device as claimed in claim 18 wherein said virtual surfing surface is at least partially submerged within said body of fluid up to a depth of approximately 300 mm.

21. A surfing device as claimed in claim 1 further comprising another surfing surface positioned between said plurality of energy projecting positions and said virtual surfing surface.

22. A surfing device as claimed in claim 21 wherein said at least one energy projecting means is arranged to project said energy through said other surface.

23. A surfing device as claimed in any claim 21 wherein said device further comprises fluid relief means arranged for removing excess fluid from said other surface.

24. A surfing device as claimed in claim 23 wherein said fluid relief means is arranged to modify said surfing.

25. A surfing device as claimed in claim 24 wherein said modification is arranged to alter at least one or more of the following characteristics of said surfing: drag; an angle at which said energy is projected; penetration of said projected energy.

26. A surfing device as claimed in claim 21 wherein said other surface is constructed of connected modules.

27. A surfing device as claimed in claim 1 wherein said energy projecting structure or energy projecting means, or both said energy projecting structure and said energy projecting means, is or are further arranged for adjustment of a position in space of at least one or more portions of said virtual surfing surface.

28. A method of enabling surfing comprising the steps of a. providing at least one energy projecting means and at least one corresponding energy projecting structure, said at least one energy projecting structure being arranged to support and position said energy projecting means to provide a plurality of energy projecting positions for projection of energy therefrom and said energy projecting means being arranged to project energy to provide a virtual surfing surface positioned relative to each of said plurality of energy projecting positions a predetermined distance therefrom in a direction of projection of said energy;

b. arranging said energy projecting structure to support and position said energy projecting means to provide said plurality of energy projecting positions; and c. arranging said energy projecting means to project energy from said plurality of energy projecting positions to provide said corresponding virtual surfing surface, and to thereby enable, upon projection of said energy, a surfer to surf at least substantially naturally upon said virtual surfing surface at least partially solely via said projected energy.

29. A surfing device kit of parts comprising a. components for construction of at least one energy projecting means and at least one corresponding energy projecting structure, said at least one energy projecting structure being arranged to support and position said energy projecting means to provide a plurality of energy projecting positions for projection of energy therefrom and said energy projecting means being arranged to project energy to provide a virtual surfing surface positioned relative to each of said plurality of energy projecting positions a predetermined distance therefrom in a direction of projection of said energy; instructions for assembly of said components to construct said energy projecting means and structure, and to support and position said energy projecting means via said energy projecting structure to provide said plurality of energy projecting positions; and b. instructions to project energy from said plurality of energy projecting positions to provide said corresponding virtual surfing surface, and to thereby enable a surfer to surf at least substantially naturally upon said virtual surfing surface at least partially solely via said projected energy.

* * * * *